United States Patent [19]

Smith

[11] Patent Number: 4,914,765

[45] Date of Patent: Apr. 10, 1990

[54] PILLOW AND SHOVEL ASSEMBLY

[76] Inventor: Shayne H. Smith, 2108 Morganton Rd., Fayettsville, N.C. 28305

[21] Appl. No.: 247,378

[22] Filed: Sep. 21, 1988

[51] Int. Cl.[4] ..... A47C 20/00

[52] U.S. Cl. ..... 5/434; 5/437; 5/441; 5/442

[58] Field of Search ..... 5/417, 420, 434, 437, 5/441, 442, 485, 490; 141/108; 294/51; 238/14; 446/70

[56] References Cited

U.S. PATENT DOCUMENTS

| | | | |
|---|---|---|---|
| 1,174,068 | 3/1916 | Hincks | 446/70 |
| 4,193,152 | 3/1980 | Seibold, Jr. | 5/490 |
| 4,272,575 | 6/1981 | Egigan | 135/116 X |
| 4,494,133 | 2/1985 | Prince | 5/417 X |
| 4,688,286 | 8/1987 | Miker, Jr. | 5/434 X |

*Primary Examiner*—Michael F. Trettel
*Attorney, Agent, or Firm*—Richard C. Litman

[57] ABSTRACT

A pillow assembly includes a top and bottom panel joined together to provide a pillow having an inner cavity accessible through an end opening formed with a closeable fastener. A scoop element is tethered to the pillow and is used to fill the cavity with on-scene shiftable, granular material such as sand, following which the scoop element is stowed within a pocket formed on the outer face of the pillow bottom panel. One or more other pockets on the bottom panel allow stowage of personal articles. In use, a person's head is comfortably supported atop the pillow while the granular material within the pillow shifts to accommodate the scoop element and other articles within the pockets.

4 Claims, 1 Drawing Sheet

PILLOW AND SHOVEL ASSEMBLY

FIELD OF THE INVENTION

This invention relates to a pillow assembly primarily for beach, lake or other outdoor use and having exterior compartments incorporated thereon for both users' personal articles and a tethered scoop for use in filing the normally empty pillow with sand or other granular material whereby it may be used as a head support.

BACKGROUND OF THE INVENTION

Traditionally, beachgoers have had to resort to inconvenient, cumbersome means of head support for use while relaxing at the beach.

Heretofore, pillow devices have been proposed, such as that shown in U.S. Pat. No. 4,535,878 issued Aug. 20, 1985 to Grahl and which provides a bag device including a plurality of inner compartments and a bifurcated pillow panel. However, the Grahl invention does not include a means for quick storage such as the present invention and provides only means for resting in a prone or supine position. The present invention provides a means for resting in a diversity of positions and ineludes integral means for the storage of a shovel element tethered to the pillow. U.S. Pat. No. 3,900,910 to Nakata, dated Aug. 26, 1975 shows a pillow device which can be filled with water and drained by means of an orifice incorporated within an upper section of the pillow. U.S. Pat. No. 4,195,378 issued Apr. 1, 1980 to Parker discloses an oversized, heavy beach towel with sealable pockets at one end. One of the pockets is large enough to allow it to be used as a pillow when filled with soft, bulky material. While many devices which can serve as pillows for outdoor use are known, they are, in general, expensive, large and otherwise inconvenient to use.

SUMMARY OF THE INVENTION

The present invention relates to a pillow assembly or kit which may be used outdoors and is readied for use after arrival at the intended point of use, such as at a lake or beach. Included are accommodations for carrying accessories which are used while sunning, swimming or engaging in other recreational activities. Most particularly, a tethered scoop or shovel is provided to allow filling of the pillow cavity with on-scene granular or particulate material of shiftable or non-packing nature. In this manner, a pillow is provided which, while offering a firm, positive elevated head support, also forms definite depressions substantially conforming to the rested body member as well as the contained shovel and other personal items stored in pockets in the bottom panel of the pillow. With such construction, the user is comfortable supported without awareness of the stored shovel and other items in the pillow, since the granular filler material within the pillow shifts to conform to the structure of the stored items. This is contrary to conventional pillow fillers such as down, feathers or synthetic materials, which compress or pack and thus transmit deformations from one face to the other.

Accordingly, an object of the present invention is to provide a pillow assembly for beachgoers as well as for other outdoor or recreational uses and which is convenient to use, of relatively simple and inexpensive construction, and can serve to support the head of the user and for the storage of personal items.

It is a further object of the invention to provide a pillow assembly comprising a top and a bottom polygonal panel composed of a soft, flexible material such as terry cloth and which forms an inner cavity closeable by releasably means such as a zipper. This cavity is normally empty but is fillable with sand or similar granular material by a tethered shovel.

Another object of the invention is to provide a pillow having a plurality of compartments attached to the bottom panel which are either open ended or provided with an integral flap closure with an attaching device.

A still further object of the invention is to provide a pillow assembly including a scooping device in combination with a pillow fillable with sand and with a tether joining the scoop and pillow.

with these and other objects in view which will more readily appear as the nature of the invention is better understood, the invention consists of the novel construction, combination and assembly hereinafter more fully illustrated, described and claimed, with reference being made to the accompanying drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
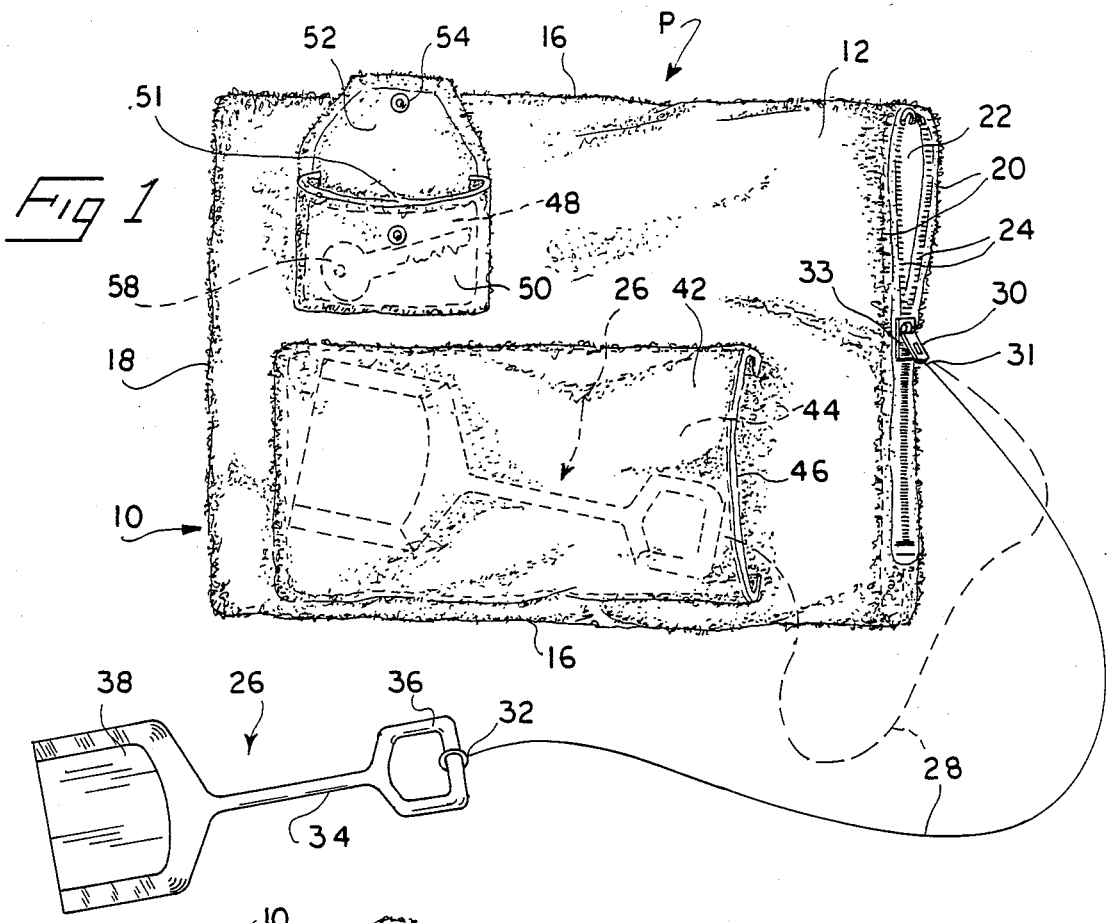
FIG. 1 is a bottom plan view of the pillow assembly according to the present invention.

Referring now to the drawings, particularly FIG. 1, the present invention will be seen to comprise a pillow assembly, generally designated P and which includes a pillow 10, preferably of polygonal configuration, having a bottom panel 12 and top panel 14. The material of the pillow panels 12, 14 will be understood to be any suitable soft, flexible yet heavy duty material. Terry cloth is an excellent choice in view of its comfort and durability. Cotton is acknowledged for its quick drying property and although terry cloth exhibits a pile-like finish, sand or other particulate material is readily brushed therefrom. Two longitudinal edges 16-16 of the pillow panels are suitably joined together, such as by close stitching as are also the juxtaposed transverse edges 18 at one end of the two panels, leaving the remaining opposite end edges 20-20 non-permanently attached to one another. An appropriate lining 22 overlies the inner faces of the two panels 12,14 and preferably comprises a close-weave or other construction which is impervious to fine sand and which may also be moisture proof.

The above panels 12,14 form an inner compartment or cavity C which is adapted to be filled with on-scene particulate or granular material, such as sand, following which, the end opening of the pillow P is closed by separable fastener means, such as the illustrated zipper strips 24-24 adapted to be joined and separated by the zipper actuator body 33.

To fill the pillow interior C at its place of intended use, such as on a beach, the assembly P includes a scoop or shovel 26 which is tethered to the pillow 10 by means of the flexible line or tether 28, a first or one end 29 of which is secured to the pillow, preferably in the area of the open end edges 20. A suitable point for this attachment is the pull-tab 30 of the zipper zipper actuator body 33. The second or opposite end 32 of the tether is affixed to the shank 34 or handle 36 of the shovel 26, preferably at its end removed from the scoop portion 38 of the shovel. With the above construction, a user manipulates the shovel to collect and deposit on-scene filler material 40 such as beach sand, from the surrounding area and into the pillow inner cavity C until this cavity is substantially full. Then, the closure means or zipper actuator body 33 is actuated to seal off the enclosed filler 40.

Figure 2:
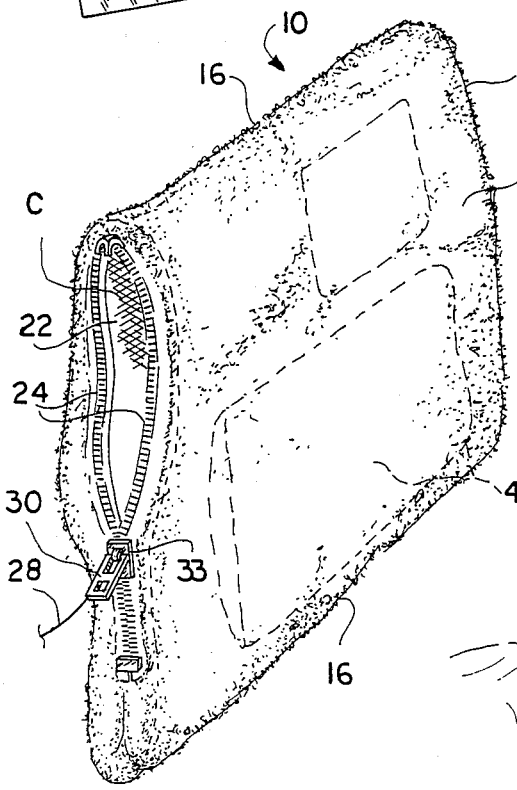
FIG. 2 is an end perspective view of the assembly shown in FIG. 1.

Before using the filled pillow 10, the tethered shovel is stowed in an out of the way manner so that the user or other persons in the area will not trip over it. As shown in FIGS. 1 and 2, the bottom pillow panel 12 is provided with a patch 42 suitably affixed along three sides to form an elongated pocket or compartment 44 accessible through the end opening 46 disposed adjacent the end edge 20 of the bottom pillow panel 12. The dimensions of this patch 42 and the formed inner pocket 44 will be understood to be no less than the overall length and width of the tethered shovel 26 such that the shovel is readily accommodated in a stowed condition fully within the pocket 44 when not in use. To permit the above operation it will follow that the tether 28 must be long enough to allow manipulation of the shovel while filling the pillow cavity C and to permit its stowage within the pocket 44. Quite obviously, surplus length of the tether may be urged into the same pocket 44 which the shovel is placed as shown in broken lines in FIG. 1 and likewise, releasable fastener means (not shown) may be included to at least partially close the shovel pocket opening.

An additional pocket or compartment 48 is formed by means of a patch 50 likewise secured along three sides to provide an opening 51 that is preferably closeable by a flap 52 having suitable fastening means 54 thereon. This latter compartment is intended to provide a secure area for the user to retain small personal items such as keys 58, currency, etc. The material 42, 50 forming both pockets preferably is of the same type as that forming the pillow panels. It will be appreciated that any desired number of additional pockets may be provided on the exterior of the pillow but all should be on the bottom panel 12 for obvious reasons.

Figure 3:
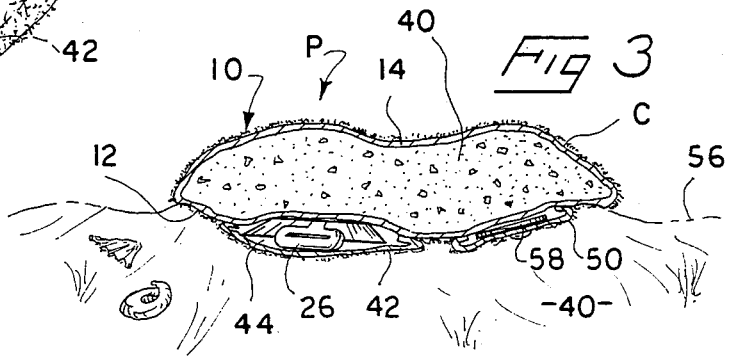
FIG. 3 is a transverse sectional view, taken along the line 3—3 of FIG. 1, with the pillow filled with particulate material and in use.

When the pillow is filled with sand or other fine, shiftable granular material it is placed in a position wherein the panel 14, which has no attached compartments, is in an upward-facing position while the bottom panel 12 is disposed upon the underlying supporting surface 56 which often will comprise the same material as the pillow filler 40. In this use position as shown in FIG. 3, it will be seen that the sand or fine granular material 40 within the pillow automatically shifts to conform to the projection of the contents of the compartments located on the pillow bottom panel 12. When the material of the supporting surface 56 also comprises a shiftable particular material, such as sand at a beach, it will be seen that this supporting sand likewise will be displaced to partially accommodate the configuration of the stowed shovel 26 as well as articles 58 within the other compartment(s) 48. With the above construction in mind it will be appreciated that an improved pillow assembly is provided which allows a user to transport, in a compact manner, a pillow which is subsequently filled with on-scene material by its own tethered implement that is then stowed within a compartment. The bottom location of the compartments insures that the user will not experience any discomfort due to its bulk. When one is finished using the pillow at any one time, the granular material is readily removed to provide an empty compact assembly which can be folded, if desired, for easy transport and storage.

Though the invention has been described with respect to a preferred embodiment, many variations and modifications will become apparent to those skilled in the art and accordingly, this invention encompasses all such variations as will come within the scope of the appended claims.

I claim:

1. A pillow assembly fillable with granular material comprising:

a pillow including substantially rectangular and congruent overlying top and bottom panels each having inner and outer faces and a plurality of peripheral edges including a pair of major longitudinal edges and one each minor transverse and opposite end edge, means joining together all of the edges exclusive of at least a portion of said end edge of each said panel to provide a cavity between said panels and an end opening adjacent said unjoined end edges of said panels to permit access to said cavity, zipper closure means on said unjoined end edges including a slidable zipper actuator body having a pull tab operable to selectively open and close said end opening defined by said unjoined end edges of said pillow panels, stowage means on said outer face of said bottom panel including an elongated patch affixed thereto parallel to said longitudinal edges and defining a pocket having an end opening parallel and adjacent said pillow end opening, a flexible tether having opposite first and second ends, an elongated shovel having a handle, said shovel defining an overall length no greater than that of said elongated patch pocket, said tether first end affixed to said zipper actuator body pull tab and said tether second end affixed to said shovel handle, whereby said tethered shovel is insertable and removable from said storage means both before and after filling said cavity with particulate material.

2. A pillow assembly according to claim 1 wherein, said top and bottom panels include an inner lining of closely woven, substantially impervious material.

3. A pillow assembly according to claim 1 wherein, said storage means comprises a plurality of pockets.

4. A pillow assembly according to claim 3 wherein, at least one said pocket includes an opening adjacent and parallel one said longitudinal panel edge, and an integral flap closure having fastening means thereon.

* * * * *